US008262305B2

(12) United States Patent
Lam et al.

(10) Patent No.: US 8,262,305 B2
(45) Date of Patent: Sep. 11, 2012

(54) PACKAGE AND APPLICATOR FOR LIQUID OR SEMI-LIQUID COMPOSITION

(75) Inventors: Uyen Tuong Ngoc Lam, Appleton, WI (US); Corey Thomas Cunningham, Larsen, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 993 days.

(21) Appl. No.: 12/080,052

(22) Filed: Mar. 31, 2008

(65) Prior Publication Data

US 2009/0241277 A1 Oct. 1, 2009

(51) Int. Cl.
*B43K 5/14* (2006.01)

(52) U.S. Cl. ..... 401/133; 401/132

(58) Field of Classification Search ..... 401/132, 401/133, 25, 183, 186
See application file for complete search history.

(56) References Cited

U.S. PATENT DOCUMENTS

| | | | |
|---|---|---|---|
| 2,621,784 | A | 12/1952 | Van Boytham |
| 3,196,478 | A | 7/1965 | Baymiller et al. |
| 3,338,992 | A | 8/1967 | Kinney |
| 3,341,394 | A | 9/1967 | Kinney |
| 3,369,267 | A | 2/1968 | Friedland et al. |
| 3,414,927 | A | 12/1968 | Worcester |
| 3,542,615 | A | 11/1970 | Dobo et al. |
| 3,608,708 | A | 9/1971 | Storandt |
| 3,657,760 | A | 4/1972 | Kudisch |
| 3,692,618 | A | 9/1972 | Dorschner et al. |
| 3,802,817 | A | 4/1974 | Matsuki et al. |
| 3,849,241 | A | 11/1974 | Butin et al. |
| 4,071,921 | A | 2/1978 | Jury |
| 4,340,563 | A | 7/1982 | Appel et al. |
| 4,372,098 | A | 2/1983 | Mason |
| 4,696,393 | A | 9/1987 | Laipply |
| 4,762,124 | A | 8/1988 | Kerch et al. |

(Continued)

FOREIGN PATENT DOCUMENTS

GB 2 108 921 A 5/1983

(Continued)

OTHER PUBLICATIONS

"Non-Newtonian Fluid," Wikipedia, the Free Encyclopedia, Internet web page "http://en.wikipedia.org/wiki/Non-Newtonian_fluid", viewed and printed on Sep. 12, 2005, 2 pages.

(Continued)

*Primary Examiner* — Dinh Q Nguyen
*Assistant Examiner* — Viet Le
(74) *Attorney, Agent, or Firm* — R. Joseph Foster, III

(57) ABSTRACT

The present disclosure provides a package for storing and applying a liquid or semi-liquid composition to an exposed surface. The package has a body having a first side, a second side, a first end, a second end, and an interior cavity located between the first and second ends wherein the first and second sides connect the first end to the second end, and an opening at the first end. A liquid or semi-liquid composition, meant to be applied to the surface, is located and stored in the interior cavity of the body. A substrate is included over the opening of the package capable of transferring the liquid or semi-liquid composition onto the surface. In an exemplary aspect, the package further includes a cover portion positioned over the opening which encloses the substrate and seals the opening in the package.

27 Claims, 3 Drawing Sheets

U.S. PATENT DOCUMENTS

| | | | | |
|---|---|---|---|---|
| 4,893,956 | A | 1/1990 | Wojcik et al. | |
| 4,904,524 | A | 2/1990 | Yoh | |
| 5,017,365 | A | 5/1991 | Niedbala | |
| 5,019,058 | A | 5/1991 | Storandt | |
| 5,046,608 | A | 9/1991 | Laipply | |
| 5,254,109 | A | 10/1993 | Smith et al. | |
| 5,284,703 | A | 2/1994 | Everhart et al. | |
| 5,301,490 | A | 4/1994 | Storandt | |
| 5,316,400 | A * | 5/1994 | Hoyt et al. | 401/132 |
| 5,356,397 | A | 10/1994 | Storandt | |
| 5,368,581 | A | 11/1994 | Smith et al. | |
| 5,389,202 | A | 2/1995 | Everhart et al. | |
| 5,454,207 | A | 10/1995 | Storandt | |
| 5,460,620 | A | 10/1995 | Smith et al. | |
| 5,487,932 | A | 1/1996 | Dunshee | |
| 5,502,946 | A | 4/1996 | Storandt | |
| 5,511,689 | A | 4/1996 | Frank | |
| 5,584,163 | A | 12/1996 | Storandt | |
| 5,648,083 | A | 7/1997 | Blieszner et al. | |
| 5,730,721 | A | 3/1998 | Hyatt et al. | |
| 5,741,564 | A | 4/1998 | Gillberg Laforce | |
| 5,833,061 | A | 11/1998 | Storandt | |
| 5,839,608 | A | 11/1998 | Gillberg Laforce | |
| 6,054,120 | A | 4/2000 | Burgoyne et al. | |
| 6,074,630 | A | 6/2000 | Devillez et al. | |
| 6,113,271 | A * | 9/2000 | Scott et al. | 383/211 |
| 6,120,783 | A | 9/2000 | Roe et al. | |
| 6,149,934 | A | 11/2000 | Krzysik et al. | |
| 6,250,829 | B1 | 6/2001 | Brower et al. | |
| 6,270,487 | B1 | 8/2001 | Sheehan et al. | |
| 6,315,482 | B1 | 11/2001 | Girardot et al. | |
| 6,322,271 | B1 | 11/2001 | Girardot et al. | |
| 6,326,069 | B1 | 12/2001 | Barnett et al. | |
| 6,406,206 | B1 | 6/2002 | Girardot et al. | |
| 6,446,795 | B1 | 9/2002 | Allen et al. | |
| 6,533,765 | B1 | 3/2003 | Blaney et al. | |
| 6,547,468 | B2 | 4/2003 | Gruenbacher et al. | |
| 6,726,386 | B1 | 4/2004 | Gruenbacher et al. | |
| 6,806,213 | B2 | 10/2004 | Brooks | |
| 6,811,338 | B1 | 11/2004 | Manske, Jr. et al. | |
| 6,846,784 | B2 | 1/2005 | Engel et al. | |
| 6,863,960 | B2 | 3/2005 | Curro et al. | |
| 7,240,790 | B2 | 7/2007 | Wendel et al. | |
| 2004/0121106 | A1 * | 6/2004 | Cobeiros et al. | 428/42.3 |
| 2004/0223802 | A1 * | 11/2004 | Bergey et al. | 401/133 |
| 2004/0228811 | A1 | 11/2004 | Krzysik | |
| 2005/0118237 | A1 | 6/2005 | Krzysik et al. | |
| 2006/0078515 | A1 | 4/2006 | Kamrin-Balfour | |
| 2006/0151341 | A1 | 7/2006 | Hufnagle | |
| 2007/0130706 | A1 | 6/2007 | Buhrow et al. | |
| 2007/0131342 | A1 | 6/2007 | Buhrow et al. | |
| 2007/0167569 | A1 * | 7/2007 | Botros | 525/71 |
| 2007/0189835 | A1 * | 8/2007 | Klocke et al. | 401/133 |
| 2007/0201771 | A1 | 8/2007 | Takada et al. | |

FOREIGN PATENT DOCUMENTS

| | | | |
|---|---|---|---|
| JP | 07-041016 | A | 2/1995 |
| JP | 2001-192045 | A | 7/2001 |
| JP | 2003-267401 | A | 9/2003 |
| JP | 2007-253994 | A | 10/2007 |
| WO | WO 85/03275 | A1 | 8/1985 |
| WO | WO 2004/108036 | A1 | 12/2004 |
| WO | WO 2007/067272 | A1 | 6/2007 |
| WO | WO 2007/067274 | A1 | 6/2007 |

OTHER PUBLICATIONS

Lawrence, K.D. et al., "An Improved Device for the Formation of Superfine, Thermoplastic Fibers," NRL Report 5265, U.S. Naval Research Laboratory, Washington, D.C., Feb. 11, 1959, pp. 1-7.

Wente, V.A. et al., "Manufacture of Superfine Organic Fibers," NRL Report 4364, U.S. Naval Research Laboratory, Washington, D.C., May 25, 1954, pp. 1-15.

* cited by examiner

PACKAGE AND APPLICATOR FOR LIQUID OR SEMI-LIQUID COMPOSITION

BACKGROUND

1. Field

The present disclosure relates to a package for storing and applying a liquid or semi-liquid composition. More particularly, a package for providing a convenient single or multiple use package storing a predetermined amount of a liquid or semi-liquid composition and providing a uniform application of a liquid or semi-liquid composition on to a surface is disclosed.

2. General Background

Delivery of various liquid or semi-liquid compositions to a surface is needed or desired in many different occasions. In situations where a person in need of a liquid or semi-liquid composition is away from home or the person needs a single dose or a single use portion, it is often desirable to have the package be able to deliver the composition to a surface. Examples of such situations include, for example, first aid applications, such as, cleaning a wound, medical treatment of a wound to prevent infections or promote healing and the like, operating room disinfecting solutions, cleaning solutions for skin and hard surfaces, shoe polish, hand or skin lotions, cosmetics, and medicaments for treating skin sores. The package should allow the user to deliver the liquid or semi-liquid composition to a desired surface without the composition coming into contact with the user's hands or body, unless the desired surface is the user's hands or body. In addition, the packaging device should effectively store the composition without leakage or deterioration of the composition prior to use.

Packaging for storing and applying a liquid or semi-liquid composition to a surface is known in the art. Many different designs have been suggested, but each has drawbacks which makes the designs less desirable. Some of the drawbacks of prior packaging solutions include, for example, cost, ease of use, the ability to accurately and uniformly apply the composition to the desired area of the surface, etc.

For example, packages known to those skilled in the art include a delivery device made of a liquid permeable material. These packages do not allow a user of the package to accurately and uniformly place a liquid composition onto a surface. Additionally, the applicator may leak during use.

There is a need in the art for an efficient liquid or semi-liquid composition package which may be used as a single or multiple use for uniformly applying a liquid or semi-liquid material to a surface.

SUMMARY

Generally stated, the present disclosure provides a package for storing and applying a liquid or semi-liquid composition to a surface. The package has a body having a first side, a second side, a first end, a second end, and an interior cavity located between the first and second ends wherein the first and second sides connect the first end to the second end, and an opening at the first end. A liquid or semi-liquid composition, meant to be applied to the surface is located and stored in the interior cavity of the body. A substrate is included over the opening of the package capable of transferring the liquid or semi-liquid composition onto an exposed surface. In an exemplary aspect, the package further includes a cover portion positioned over the opening which encloses a substrate in the package. The cover portion may be an extension of the body or separate pieces attached together.

In another exemplary aspect, the package for storing and applying a liquid or semi-liquid composition is manufactured with a single backing layer. The backing layer has a first portion that may be folded upon and connected to itself to form a body having an interior cavity. The body is configured to have an opening at an outer edge of the first portion. The backing layer further has a second portion extending out from the opening of the body. The second portion has a seal on an outer perimeter of the second portion and when folded over the opening and sealed to the body, seals the package.

In an exemplary aspect, a plurality of bond points are formed in the interior cavity adjacent to the opening of the body securing the first side to the second side and a gap between at least one bond point. The bond points may be formed by adhesive bonding, thermal bonding, point bonding, pressure bonding, extrusion coating, or ultrasonic bonding. The length of the gap between each bond point is dependent on the viscosity of the composition. In an exemplary aspect the length in centimeters, y, of the gap between each bond point is at least greater than the viscosity in centipoise, x, defined by the equation:

$$y = \frac{1}{3}\ln(x) - 2.4.$$

In an exemplary aspect, the gap between bond points is at least 0.3 centimeters when the composition has a viscosity between 3000 to 4000 centipoise. In further aspects, the gap between bond points is at least about 1.0 centimeter when the composition has a viscosity between 30,000 to 120,000 centipoise. In still further aspects, the gap between bond points is at least about 2.0 centimeter when the composition has a viscosity between 500,000 to 800,000 centipoise.

The package includes a substrate extending over the opening of the body capable of transferring the liquid or semi-liquid composition onto an exposed surface. The substrate may be liquid permeable and a non-woven material selected from coform, airlaid, spunbond, spunbond-meltblown-spunbond, thermal bonded, hydroentangled and carded non-woven. The substrate may also be a foam material with an open structure or a water impermeable material with apertures to controllably allow the liquid or semi-liquid composition to pass through.

In a further aspect, a seal on an outer perimeter of the cover or second portion for sealing and closing the package is disclosed. The seal may be a resealable adhesive for selectively opening and reclosing the package. In exemplary aspects, the adhesive is selected from polyolefin hotmelt adhesives and styrenic block-copolymer hotmelt adhesives.

In another aspect, the body of the package is formed from a water impermeable substrate selected from polyester film, polypropylene film, polyethylene film, nylon film, polyvinyl chloride film, metallized film, spunbond-meltblown-spunbond, and laminations thereof.

In an aspect of the present disclosure, the composition is selected from an aqueous solution, an ointment, a cream, an emulsion, a suspension, an anhydrous gel and a solvent.

In an additional aspect of the present disclosure, a method for storing and applying a liquid or semi-liquid composition is provided. The method has the steps of providing a package according to an aspect of the present disclosure, dispensing the liquid or semi-liquid composition onto the liquid permeable substrate; and transferring the liquid or semi-liquid composition to a surface by contacting the liquid permeable substrate on the surface.

The dispensing of the liquid or semi-liquid composition is accomplished by applying pressure to the first or second side of the body; pushing the liquid or semi-liquid composition through the gap between at least one bond point onto the liquid permeable substrate; and wicking the liquid or semi-liquid composition through the liquid permeable substrate to an outer surface of the liquid permeable substrate.

BRIEF DESCRIPTION

DETAILED DESCRIPTION

Figure 2:
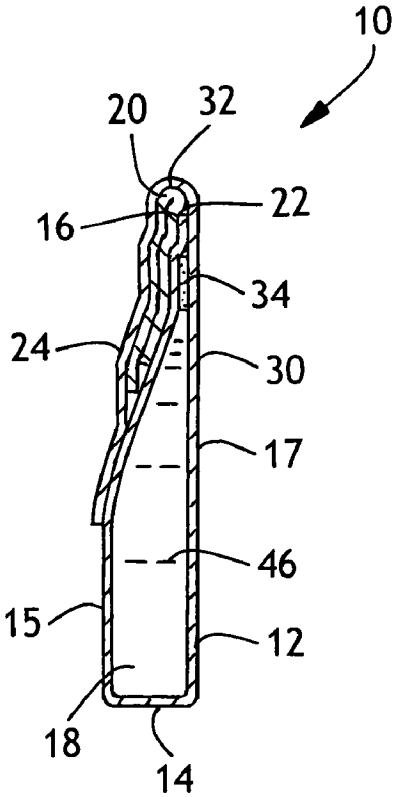
FIG. 2 illustrates a cross section view of the package of the present disclosure in a closed and sealed position.

It should be noted that, when employed in the present disclosure, the terms "comprises", "comprising" and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As used herein, the terminology such as "vertical", "horizontal", "top", "bottom", "front", "back", "end" and "sides" are referenced according to the views presented. It should be understood, however, that the terms are used only for purposes of description, and are not intended to be used as limitations. Accordingly, orientation of an object or a combination of objects may change without departing from the scope of the invention. As a point of reference for the claims and in the present specification, the term "top" refers to a panel or side of the package with an opening device or opening.

As used herein, the term "opening" refers to a portion of the package which allows the liquid or semi-liquid material to be released from the interior volume of the package.

As used herein, the term "opening device" refers to a structure on or near the cover which allows a user to easily remove the cover from the package to access the liquid permeable substrate and the liquid or semi-liquid material within the interior volume of the package. Examples of opening devices include, for example, adhesives, tabs, lines of weakness, perforations, breakable seals and other similar items which make it easier for a user to open the package.

As used herein, the term "laminate" refers to a composite structure of two or more material layers that have been adhered or otherwise bonded together, such as through adhesive bonding, thermal bonding, point bonding, pressure bonding, extrusion coating, ultrasonic bonding or by some other bonding technique known to those skilled in the art.

It should be understood that the term "semi-liquid", is intended to mean materials which are flowable under pressure and/or shear force. Semi-liquid compositions include creams, ointments, gel-like materials and other similar materials.

In the following detailed description, reference is made to the accompanying drawings which form a part hereof, and in which is shown by way of illustration, specific aspects in which the disclosure may be practiced. These aspects are described in sufficient detail to enable those skilled in the art to practice the disclosed package, and it is to be understood that other aspects may be utilized and that mechanical, procedural, and other changes may be made without departing from the spirit and scope of the present invention. The following detailed description is, therefore, not to be taken in a limiting sense, and the scope of the present disclosure is defined only by the appended claims, along with the full scope of equivalents to which such claims are entitled.

Referring to FIGS. 1-6, a delivery package 10 is illustrated for delivering a liquid or semi-liquid composition to a surface. The package 10 of the present disclosure has a body 12 with an opening 22 to dispense a uniform amount of a liquid or semi-liquid composition or formulation. The package 10 enables a user of the package to more easily, more uniformly and more sanitarily distribute a liquid or semi-liquid composition or formulation on to a surface or skin.

In an exemplary aspect, the package 10 for storing and applying a liquid or semi-liquid composition has a body 12 having a first side 15, a second side 17, a first end 16, and a second end 14. An interior cavity 18 is formed by connecting the first and second ends 16, 14 with both the first side 15 and the second side 17. Inside the interior cavity 18, a liquid or semi-liquid composition 46 is stored.

The body 12 of the package may have a hollow structure, with the second end 14 being closed and the first end 16 having an opening 22. In the alternative, the first end may not contain an opening 22 but is capable of forming an opening 22. The inner cavity 18 of the hollow structure has an interior volume which is capable of holding a liquid or semi-liquid material 46. The body 12 of the delivery package 10 may be made of a single piece of material or multiple pieces of material. In the case where there is a single piece of material, the body 12 may be prepared using methods known to those skilled in the art, such as injection molding, blow molding or other known molding processes. In an exemplary aspect, the single piece of material, or backing layer 30, may be folded over onto itself, resulting in side seams. The backing layer 30 has a first portion that may be folded upon and connected to itself to form a body 12 having an interior cavity 18. The body 12 is configured to have an opening 22 at an outer edge 32 of the first portion. The backing layer 30 further has a second portion extending out from the opening 22 of the body 12. The second portion has a seal 38 on an outer perimeter of the second portion and when folded over the opening 22 and sealed to the body 12 seals the package 10.

Other methods of forming the body 12 of the package 10, include using multiple pieces of the material. When multiple pieces are used, the presence of side seams and an end seam may be present which will require sealing. The method of forming the package 10 or the body 12 may be prepared in any way known to one skilled in the art.

The body 12 can be formed from a variety of materials, including natural and/or synthetic materials. Desirably, the body 12 is formed from a film, although a nonwoven material, a woven material or a combination of materials can be used. Typically, the materials used to prepare the body 12 should be liquid and gas impermeable so that the liquid or semi-liquid material can be retained in the interior volume 18 of the body 12 prior to use. In addition, the materials selected to form the body 12 should also be selected so at least that the first side 15 or second side 17 of the body 12 is deformable when compressive force is applied to the first or second side 15, 17 of the body 12. Acceptable water impermeable materials for use include polyester film, polyvinyl chloride film, polypropylene film, polyethylene film, nylon film, metallized film, spunbond-meltblown-sponbond (SMS), and laminations thereof. In an exemplary aspect, the body 12 can include one or more barrier layers that can be in the form of a film layer. Furthermore, the backing layer 30 can be formed of a metallized material, such as a metal foil. A common example would be a thin sheet of aluminum vapor deposited on a polymer film. Suitable materials include materials such as polymer coated paperboard, molded thermoplastic polymers, thermoplastic polymer films, molded elastomeric polymers, elastomeric polymer films, metal films or foils, and laminates of one or more of these materials wherein at least one layer is a barrier layer.

The body 12 of the package 10 may be made of a single piece of material or multiple pieces of material. In the case where there is a single piece of material, or backing layer 30, the body 12 may be prepared using methods known to those skilled in the art, such as injection molding, blow molding or other known molding processes. The body 12 of the package 10 may also be prepared from a tube-like blank. When a tube-like blank is used to form the body 12, the proximal longitudinal end 14 of the body 12 will need to be sealed, using a method known to those skilled in the art. Alternatively, the single piece of material, or backing layer 30, may be folded over onto itself, resulting in side seams 26. Other methods of forming the body 12 of the package 10, include using multiple pieces of the material. When multiple pieces are used, the presence of side seams and an end seam may be present which will require sealing. The method of forming the package 10 or the body 12 of the package is not critical to the present invention.

The second end 14 of the package may be sealed, if needed, in a manner which will prevent the package 10 and the liquid or semi-liquid composition or material 46 from leaking or otherwise escaping from the package 10 during storage or use. Likewise, any side seam 26 that may be present may be sealed using a similar sealing method. Suitable sealing methods include heat sealing, ultrasonic sealing, adhesive sealing, crimping, pressure bonding or a combination thereof, depending on materials used to prepare the body 12 of the package.

The first end 16 of the body 12 has an opening 22 which is capable of allowing the liquid or semi-liquid material to be released from the body 12. The opening 22 allows the liquid or semi-liquid composition to be dispensed from the package 10 in a controlled manner. In an exemplary aspect, the first and seconds sides 15, 17 of the body 12 are deformable under a compressive force. In this aspect, the first and second sides 15, 17 of the body 12 are configured to collapse into the interior volume of the package when a compressive force is applied to the first and second sides 15, 17 of the body 12. The first and second sides 15, 17 are configured to move the liquid composition 46 from a storage position through the opening 22.

In an exemplary aspect, to control the amount of the liquid or semi-liquid composition 46 dispensed, a plurality of bond points 34 are formed in the interior cavity 18 adjacent the opening 22 of the body 12 securing the first side 15 of the body 12 to the second side 17 of the body 12. In an exemplary aspect, the plurality of bond points securing the first side 15 of the body 12 to the second side 17 are formed utilizing ultrasonic bonding. Other bonding techniques are also available such as through adhesive bonding, thermal bonding, point bonding, pressure bonding, extrusion coating, or by some other bonding technique known to those skilled in the art. The at least one gap 36 between the plurality of bond points 34 allows the liquid composition to dispense out of the opening 22. The length of a gap between the bond points controls how much of the liquid composition will flow out of the opening 22 upon squeezing during application.

In an exemplary aspect, the length of the gap 36 between each bond point 34 is dependent on the viscosity of the liquid or semi-liquid composition 46. As the viscosity of the composition 46 is increased, the length of the gap 36 is also increased. To determine the proper length of the gap 36 for different substances, different substances were dispensed onto a surface by hand-squeezing the package. Table 1 illustrates exemplary lengths between each gap for various delivery vehicles having varying viscosities.

TABLE 1

Length of Gap based on Viscosity

| Product Type | Viscosity of Product | Gap of Bond Points |
|---|---|---|
| Spray lotion | 3000-4000 cps | 0.3 cm |
| Lotion | 31,000-120,000 cps | 1.0 cm or larger |
| Cream | 500,000-800,000 cps | 2.0 cm or larger |

In a further aspect the length is least greater than the value of the length of the gap 36 between the plurality of bond points 34, y, wherein x is the viscosity of the liquid composition to be delivered based on the following equation:

$$y = \frac{1}{3}\ln(x) - 2.4.$$

Extending over and covering the opening 22 of the body 12 is a substrate 20. The substrate 20 can be formed from a variety of materials that are liquid permeable or that are treated or coated so as to be liquid permeable. By "liquid permeable" it is meant that a liquid can penetrate or wick through all or part of the material. The substrate 20 can be made from biodegradable materials such as cellulose, chitin, etc. The substrate 20 can be viewed as a delivery member that is capable of receiving a liquid or semi-liquid composition or formulation 46, wicking the liquid or semi-liquid composition through to an outer surface of the substrate, and then delivering and spreading the liquid or semi-liquid composition or formulation 46 to another surface or member. The substrate 20 can be a nonwoven web. As used herein, the term "nonwoven web" means a web having a structure of natural, synthetic or mixtures of natural and synthetic fibers or threads which are interlaid, but not in an identifiable, repeating manner. Nonwoven webs can be formed by a variety of processes, such as a meltblown process, a spunbond process, a hydroentangling process, a wet-laid process, an air-laid process, a thermal bonded process, a bonded carded web process, etc.

The substrate 20 can also be formed from an airlaid nonwoven, a coform, or a variety of other materials known to those skilled in the art. Airlaid nonwoven is fabric made by an air-forming process wherein the synthetic and/or wood pulp fibers are distributed by air currents to give a random orientation within the web and the fabric has isotropic properties. A coform material is a nonwoven fabric-like material comprising an air-formed matrix of thermoplastic polymer microfibers, usually polypropylene, and a multiplicity of individualized wood pulp fibers disposed throughout the matrix of microfibers and engaging at least some of the microfibers to space the microfibers apart from each other.

The substrate 20 can also be a bonded carded web. As used herein, the term "bonded carded web" refers to a web that is made from staple fibers which are usually purchased in bales. The bales are placed in a fiberizing unit/picker which separates the fibers. Next, the fibers are sent through a combing or carding unit which further breaks apart and aligns the staple fibers in a machine-direction so as to form a machine-direction-oriented fibrous nonwoven web. Once the web has been formed, it is then bonded by one or more of several bonding methods. One bonding method is powder bonding wherein a powdered adhesive is distributed throughout the web and then activated, usually by heating the web and adhesive with hot air. Another bonding method is pattern bonding wherein heated calender rolls or ultrasonic bonding equipment is used to bond the fibers together, usually in a localized bond pattern through the web, and/or alternatively, the web may be bonded across its entire surface, if so desired. When using bicomponent staple fibers, through-air bonding equipment is, for many applications, especially advantageous.

The substrate 20 can also be a spunbond, a spunbond laminate (SBL) or a bicomponent spunbond. As used herein, the term "spunbond" refers to small diameter fibers which are formed by extruding molten thermoplastic material as filaments from a plurality of fine, usually circular capillaries of a spinneret, with the diameter of the extruded filaments being rapidly reduced, such as by methods and apparatuses known to those skilled in the art.

Furthermore, the substrate 20 can be a meltblown substrate. As used herein, the term "meltblown" means fibers formed by extruding a molten thermoplastic material through a plurality of fine, usually circular die capillaries as molten threads or filaments into converging high velocity gas (i.e. air) streams which attenuate the filaments of molten thermoplastic material to reduce their diameter. The diameter of the meltblown may be reduced to microfiber diameter. Thereafter, the meltblown fibers are carried by the high velocity gas stream and are deposited on a collecting surface to form a web of randomly dispersed meltblown fibers.

The substrate 20 can also be an open foam material, in which the foam structure is open to allow the liquid or semi-liquid 46 to pass through. The substrate 20 can further be a water impermeable material with apertures, which are openings to controllably allow the liquid or semi-liquid 46 to pass through.

The composition or formulation 46 is of such a consistency and characteristic that it is capable of being transferred from the substrate 20 onto an exposed surface by wiping or moving the substrate 20 against the exposed surface. The exposed surface can be an area or part of a human body, such as the skin or hair. The exposed surface can also be an area or part of an animal's body including its skin, hair or fur. In addition, the exposed surface can be an area or part of a natural plant, flower, tree, etc. Furthermore, the exposed surface can be an inanimate object, such as a piece of furniture, the hood of a car, an eating utensil, fabric, carpeting, clothing, etc.

The composition or formulation 46 can be a variety of items including but not limited to aqueous solutions, ointments, creams, emulsions, solvents, suspensions, etc. The composition or formulation 46 can be any of a variety of skin treatments that can be delivered in effective amounts from the substrate 20 to a human's skin. Such skin treatments include but are not limited to alpha and/or beta hydroxy-acids, analgesics, antimicrobials, antibodies, anti-acne, anti-irritants, antigens, anesthetics, anti-inflammatory substances, antioxidants, anti-adherents, anti-pruritic materials, astringents, botanicals, botanical extracts, buffers, chelators, cleansing compositions, emollients, exfolliants, proteins, lipids, carbohydrates, derivatives of each of the previous three items, enzymes, enzyme inhibitors, growth factors, irritant sequestrants, skin lightening agents, hair care compositions, depilatory compositions, shaving aids, fragrances, metal salts, microbial growth factors, microorganisms, odor absorbents, oxidizers, probiotics, moisturizers, color cosmetics, vasoconstrictors, muscle relaxants, lubricants, sunscreens, insect repellents, skin protectants, surfactants, vitamins, volatile organic compound (VOC) absorbents, material to alter skin and/or hair surface energy, and the like could be delivered alone or in any number of permutations or combinations.

The liquid or semi-liquid composition or formulation 46 can also be in the physical form of a liquid, a lotion, a gel, a cream, an emulsion, and a semi-liquid. The liquid or semi-liquid composition or formulation 46 can be a medicament, a petroleum gel, a highly viscous product, an ointment having a gel-like consistency, etc.

The liquid or semi-liquid composition or formulation 46 can be a skin care product that is homogeneous or uniform in structure. When the composition or formulation 46 is a skin care product, it can be made to rapidly de-emulsify upon application to the skin. Furthermore, when the liquid or semi-liquid composition or formulation 46 is a skin care product, it can be manufactured such that it has the ability to inhibit the growth of a broad range of bacteria, fungi and other microorganisms, if desired.

The liquid or semi-liquid composition or formulation 46 can also include one or more additives. A lubricant can be added to reduce abrasion with the skin. A colorant can be added to impart a particular color. A fragrance can be added to provide a pleasant odor. These and other additives known to those skilled in the art can be utilized.

It should also be understood that any of a variety of non-skin care liquid or semi-liquid compositions or formulations can be delivered from the substrate 20 of the package 10. These include but are not limited to hard surface disinfectants, ultraviolet (UV) protectants, sunscreens, sanitizers, polymer conditioners, polishes, scrubbing agents, cleansing solutions, cleansers, degreasers, adhesives, lubricants, soil repellents, water repellents, pesticides, insect repellents, pest baits, bleaching agents, antimicrobials, acids, bases, fragrances, pesticides, paints, latex paints and the like. For some non-skin care compositions or formulations, they do not have to be homogeneous or exhibit the above-identified features desirable in a skin care composition or formulation.

A variety of vehicles for delivering any one of the above identified compositions or formulations 46 from the substrate 20 of the package 10 are envisioned. These include but are not limited to ointments, macro, micro and nano emulsions, creams, suspensions, solutions and the like. The vehicles may contain water but anhydrous vehicles are also envisioned. In certain aspects, these vehicles might also include encapsulation technologies, such as liposomes, colloidosomes, coated particulates and other methods known to those skilled in the art. Application of the composition or formulation 46 to any anatomical site on the human body, to the body of an animal, or to an inanimate object is envisioned.

Figure 1:
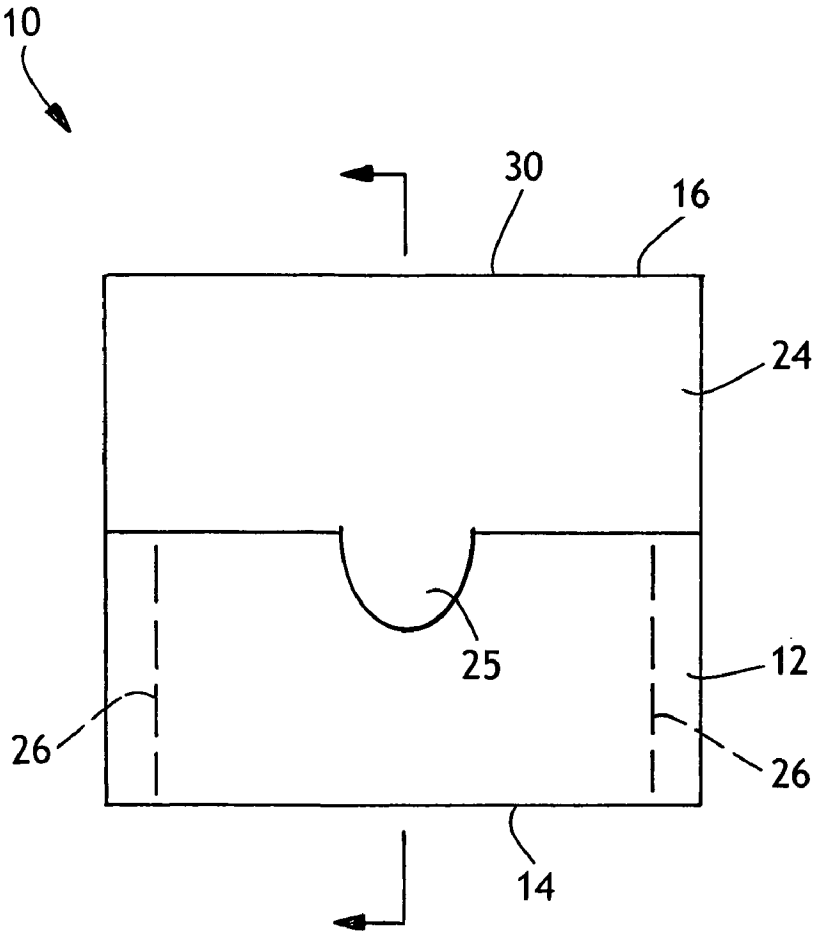
FIG. 1 illustrates a front plan view of a package of the present disclosure in a closed and sealed position.
Figure 4:
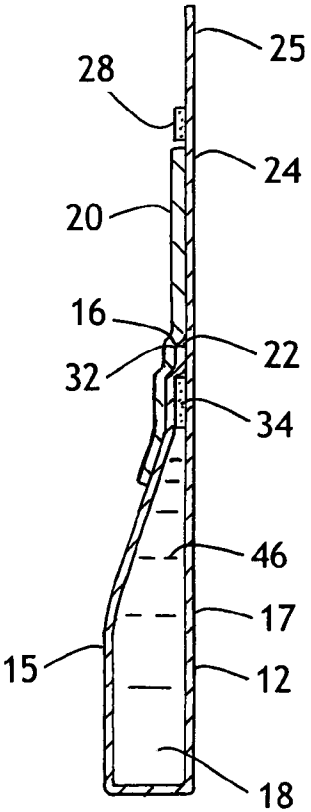
FIG. 4 illustrates a cross section view of the package of the present disclosure prior to use in an open position.
Figure 3:
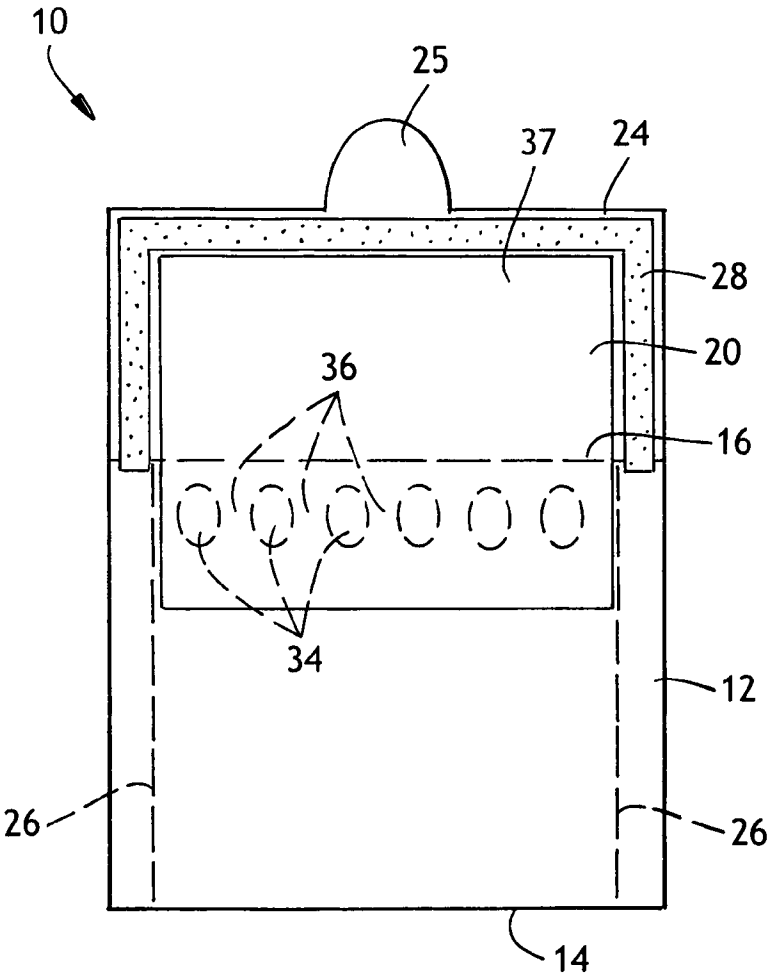
FIG. 3 illustrates a front plan view of a package of the present disclosure prior to use in an open position.

In one aspect and illustrated in FIGS. 1 and 2, the substrate 20 and opening 22 of the device 10 may be sealed by a cover 24. The cover 24 is a gas and liquid impermeable material which serves to hold the liquid or semi-liquid material 46 within the package 10, thereby preventing leakage or evaporation of the liquid or semi-liquid composition 46. The cover also serves to keep liquid or semi-liquid composition 46 from becoming contaminated during storage and before use. The cover 24 is removable prior to use by the user. The cover 24 may be a separate piece of material from the body 12 or may be made from the same material as the body 12 and may be an extension of at least one side of the body 12. If the cover 24 is a separate piece of material from the body 12, suitable materials include, for example, polymeric films, metal foils, polymer coated papers or laminates thereof. Examples of each include, for example, a polyethylene film, aluminum foil, polymer coated paper board and the like. If the cover 24 is an extension of the body material, the cover will be prepared from the same material as the material used to form the body 12. It is also possible for the cover 24 to remain attached to the package 10 once the cover 24 is opened, or the cover 24 may be completely or partially removed from the package 10 prior to use.

The cover 24 may be held in place to the body 12 using known methods, such as using an adhesive between cover 24 and the body 12, or the other known methods such as heat sealing, pressure sealing, ultrasonic sealing and the like or a combination of these sealing procedures, depending on the material used to prepare the cover. For example, if the cover is made from a similar material used to make the body 12, the cover may be heat sealed or ultrasonically sealed to the body 12. In one aspect of the present invention, the cover 24 is sealed by using an adhesive. In addition, the cover may be imparted with an opening aid, which is a tab 25 or handle, in which the user can grasp the cover 12.

When the cover 24 is an extension of the body 12 and the cover 24 is integral with the body 12, the cover 24 may be formed with the body 12. In an exemplary aspect, the cover 24 is folded over the opening and attached to the exterior portion of the body 12 of the package 10, fully enclosing the substrate 20 and opening 22. To facilitate the opening of the integral cover 24, an opening device 28 may be associated with the cover 24. The opening device 28 allows for the separation of the cover from the body without damaging the body 12. In an exemplary aspect, the opening device 28 is a seal attached to the outer perimeter of the cover 24 to attach the cover to the body 12. The seal may be an adhesive that extends along at least two sides of the cover. Exemplary adhesives include polyolefin hotmelt adhesives and styrenic block-copolymer hotmelt adhesives. Another example of an opening device 28 is a line of weakness between the cover 24 and the body 12. As is shown in the figures, the opening aid is a tab 25 which will allow the user to grasp and remove cover 24 away from the opening 22.

In an exemplary aspect, the cover 24 is a portion of at least one side of the body 12 extending out from the opening 22 and second end of the body 12. In this aspect, one end of the substrate 20 may be attached to the cover portion of the body 12, extend over the opening 22, and wherein the second end of the substrate 20 is attached to the exterior of the body 12. In this aspect, when the cover is folded over, the liquid permeable substrate 20 is also folded and enclosed within the cover to fully enclose the opening 22 and seal the package as illustrated in FIG. 2.

The adhesive further prevents the product from escaping the inner cavity and helps to prevent contamination of the substrate 20 and the liquid or semi-liquid composition. The adhesive allows the user to open and selectively reveal the substrate 20 and allow the liquid or semi-liquid composition in the inner cavity to traverse through the substrate 20 and out of the package 10. In an exemplary aspect, the interior cavity 18 stores enough of the liquid or semi-liquid composition 46 for a single use allowing the package to be discarded after a single use. In an alternative aspect, the adhesive may be a resealable adhesive that allows a user to apply the liquid or semi-liquid composition then thereafter close and selectively reseal the package 10.

Figure 6:
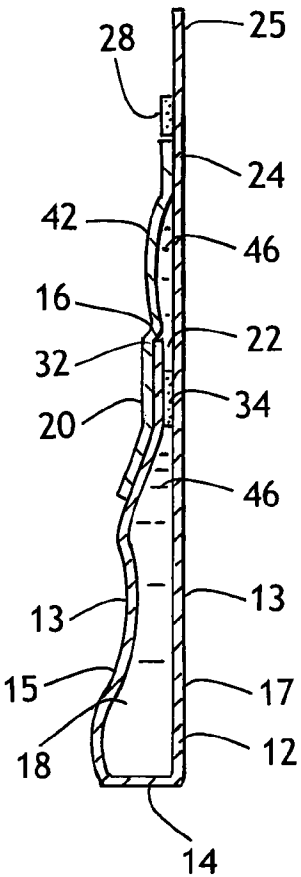
FIG. 6 illustrates a cross section view of the package of the present disclosure with the package in a use position.
Figure 5:
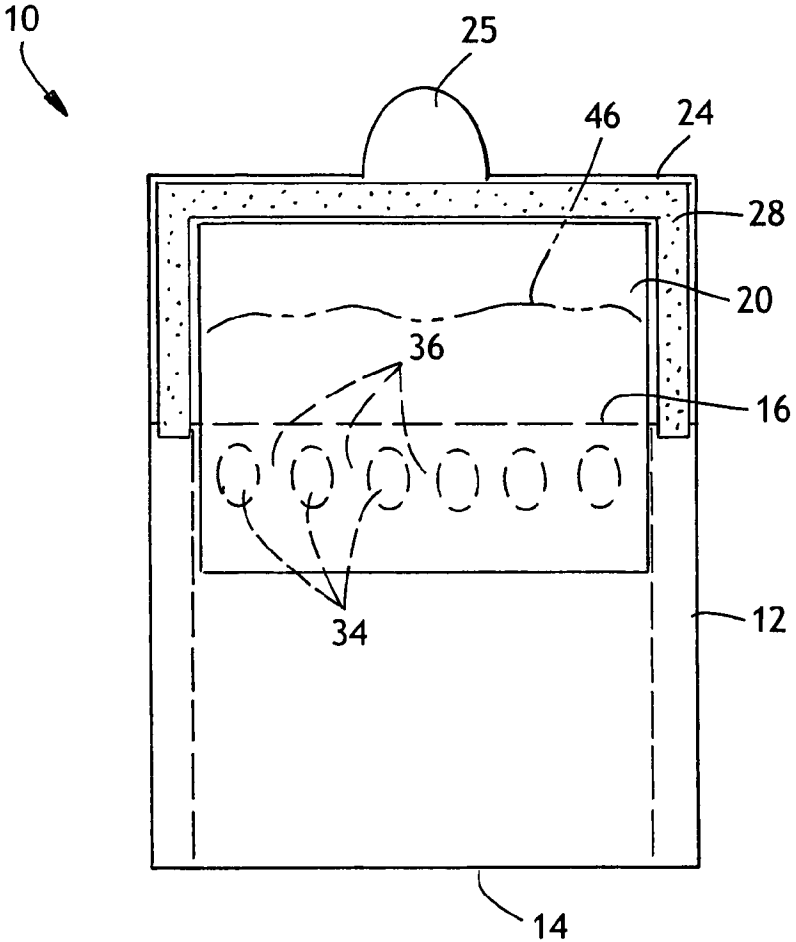
FIG. 5 illustrates a perspective view of a package of the present disclosure with the package in a use position.

To utilize the disclosed package, the consumer would first remove the cover utilizing the tab 25 to reveal the substrate 20. Next, the user applies a compressive force to the side or sides 15, 17 of the body 12 of the package 10 which causes the sides 15, 17 of the body 12 to collapse inward towards the interior volume 18 of the package 10 as shown in FIG. 6. Typically, a user will apply the compressive force needed to collapse the side 15, 17 of the body 12 by squeezing the side 15, 17 between the thumb and forefinger. The first and second sides 15, 17 are configured to move the liquid or semi-liquid composition 46 from a storage position through the opening 22 and onto the liquid permeable substrate 20. In exemplary aspects, the liquid or semi-liquid composition 46 passes or wicks through the liquid permeable substrate 20 and onto an outer surface 42 of the liquid permeable substrate 20 to allow a user to transfer the liquid composition onto another surface. The liquid permeable substrate 20 would then spread the liquid or semi-liquid composition 46 uniformly onto the other surface.

When introducing elements of the present disclosure or the preferred aspects(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above compositions and products without departing from the scope of the disclosure, it is intended that all matter contained in the above description shall be interpreted as illustrative and not in a limiting sense.

The invention claimed is:

1. A package for storing and applying a liquid or semi-liquid composition comprising:

a body having a first side, a second side, a first end, a second end, and an interior cavity located between the first and second ends wherein the first and second sides connect the first end to the second end, and an opening at the first end, wherein the opening extends substantially an entire width of the first end;

a liquid or semi-liquid composition located in the interior cavity of the body;

a substrate extending over the opening of the body; and a plurality of bond points in the interior cavity adjacent the opening of the body securing the first side to the second side and at least one gap between the plurality of bond points wherein the liquid or semi-liquid composition may be dispensed through the gap, wherein a length of the gap between the plurality of bond points controls the amount of the liquid or semi-liquid composition dispensed.

2. The package of claim 1 further comprising a cover portion positioned over the opening which encloses the liquid permeable substrate in the package.

3. The package of claim 2 wherein the cover portion is an extension of the body and a seal on an outer perimeter of the cover portion.

4. The package of claim 3 wherein seal is a resealable adhesive.

5. The package of claim 3 wherein the seal is an adhesive selected from polyolefin hotmelt adhesives and styrenic block-copolymer adhesives.

6. The package of claim 3 wherein the body is formed from a water impermeable substrate selected from polyester film, polypropylene film, polyethylene film, polyvinyl chloride film, nylon film, metallized film, spunbond-meltblown-spunbond, and laminations thereof.

7. The package of claim 1 wherein the gap between bond points is at least 0.3 centimeters when the composition has a viscosity between 3000 to 4000 centipoise.

8. The package of claim 1 wherein the gap between bond points is at least about 1.0 centimeter when the composition has a viscosity between 30,000 to 120,000 centipoise.

9. The package of claim 1 wherein the gap between bond points is at least about 2.0 centimeter when the composition has a viscosity between 500,000 to 800,000 centipoise.

10. The package of claim 1 wherein a length, y, of the gap between each bond point is dependent on the viscosity, x, of the composition.

11. The package of claim 10 wherein the length, y, of the gap between each bond point is at least greater than the viscosity, x, defined by the equation:

$$y = \frac{1}{3}\ln(x) - 2.4.$$

12. The package of claim 1 wherein the substrate is liquid permeable and is a non-woven material selected from coform, airlaid, spunbond, spunbond-meltblown-spunbond, and carded nonwoven.

13. The package of claim 1 wherein the substrate is an open foam material, wherein the open foam material allows the liquid or semi-liquid composition to pass through.

14. The package of claim 1 wherein the substrate is a water impermeable material with apertures to controllably allow the liquid or semi-liquid composition to pass through.

15. The package of claim 1 wherein the composition is selected from an aqueous solution, an ointment, a cream, an emulsion, an anhydrous gel, a suspension and a solvent.

16. The package of claim 1 wherein the bond points are formed by adhesive bonding, thermal bonding, point bonding, pressure bonding, extrusion coating, or ultrasonic bonding.

17. A package for storing and applying a liquid or semi-liquid composition comprising:

a backing layer having a first portion and a second portion, wherein the first portion is folded upon and connected to itself to form a body having an interior cavity, the body having an opening at an outer edge of the first portion wherein the opening extends substantially an entire width of the outer edge of the first portion, and the second portion having a seal on an outer perimeter of the second portion and extending out from the opening of the body and when folded over the opening seals the package;

a liquid or semi-liquid composition located in the interior cavity of the body;

a plurality of bond points securing the first portion to itself adjacent the opening of the body providing at least one gap between the plurality of bond points wherein the liquid or semi-liquid composition may be dispensed through the gap, wherein a length of the gap between the plurality of bond points controls the amount of the liquid or semi-liquid composition dispensed; and a substrate provided inside the package extending over at least the opening of the body.

18. The package of claim 17 wherein the seal is a resealable adhesive.

19. The package of claim 17 wherein the seal is an adhesive selected from polyolefin hotmelt adhesives and styrenic block-copolymer adhesives.

20. The package of claim 17 wherein the body is formed from a water impermeable substrate selected from polyester film, polypropylene film, polyethylene film, nylon film, metallized film, polyvinyl chloride film, spunbond-meltblown-spunbond, and laminations thereof.

21. The package of claim 17 wherein a length, y, of the gap between each bond point is dependent on the viscosity, x, of the composition.

22. The package of claim 21 wherein the length, y, of the gap between each bond point is at least greater than the viscosity, x, defined by the equation:

$$y = \frac{1}{3}\ln(x) - 2.4.$$

23. The package of claim 17 wherein the substrate is liquid permeable and a non-woven material selected from coform, airlaid, spunbond, spunbond-meltblown-spunbond, and carded nonwoven.

24. The package of claim 17 wherein the composition is selected from an aqueous solution, an ointment, a cream, an emulsion, an anhydrous gel, a suspension and a solvent.

25. A method for storing and applying a liquid or semi-liquid composition comprising:

providing a package having a body having a first side, a second side, a first end, a second end, and an interior cavity located between the first and second ends wherein the first and second sides connect the first end to the second end, and an opening at the first end, wherein the opening extends substantially an entire width of the first end, a liquid permeable substrate extending over the opening of the body capable of wicking the composition and transferring the composition by applying pressure to the body and wiping the substrate on an exposed surface and a plurality of bond points in the interior cavity adjacent the opening of the body securing the first side to the second side and at least one gap between the plurality of bond points wherein the liquid or semi-liquid composition may be dispensed through the gap, wherein a length of the gap between the plurality of bond points controls the amount of the liquid or semi-liquid composition dispensed;

dispensing the liquid or semi-liquid composition onto the liquid permeable substrate; and transferring the liquid or semi-liquid composition to a liquid permeable surface by contacting the substrate on the surface;

wherein the liquid or semi-liquid composition may be dispensed through the gap.

26. The method of claim 25 wherein dispensing the liquid or semi-liquid composition comprises:

applying a pressure to the first or second side of the body;

pushing the liquid or semi-liquid composition through the gap between at least one bond point onto the liquid permeable substrate; and wicking the liquid or semi-liquid composition through the liquid permeable substrate to an outer surface of the liquid permeable substrate.

27. The method of claim 25 wherein the length, y, of the gap between each bond point is at least greater than the viscosity, x, defined by the equation:

$$y = \frac{1}{3}\ln(x) - 2.4.$$

* * * * *